US010156399B2

(12) United States Patent
Pacheco da Cunha

(10) Patent No.: US 10,156,399 B2
(45) Date of Patent: Dec. 18, 2018

(54) GRAIN DRYING TOWER OF PARALLEL AND SINUOUS FLOW THROUGH REVERSE CROSSED AIR FLOW AND RADIAL AIR FLOW IN OBLIQUE "Z" FORM

(71) Applicant: Otalicio Pacheco da Cunha, Sao Leopoldo (BR)

(72) Inventor: Otalicio Pacheco da Cunha, Sao Leopoldo (BR)

( * ) Notice: Subject to any disclaimer, the term of this patent is extended or adjusted under 35 U.S.C. 154(b) by 685 days.

(21) Appl. No.: 14/684,963

(22) Filed: Apr. 13, 2015

(65) Prior Publication Data

US 2016/0047600 A1 Feb. 18, 2016

(30) Foreign Application Priority Data

Feb. 19, 2014 (BR) ..... 10 2014 003815-9

(51) Int. Cl.
*F26B 11/12* (2006.01)
*F26B 17/12* (2006.01)
*F26B 17/14* (2006.01)

(52) U.S. Cl.
CPC ..... *F26B 17/122* (2013.01); *F26B 17/126* (2013.01); *F26B 17/14* (2013.01); *F26B 2200/06* (2013.01)

(58) Field of Classification Search
CPC ..... F26B 3/06; F26B 17/12; F26B 17/122; F26B 17/126; F26B 17/14; F26B 17/1408; F26B 17/1416; F26B 17/1425; F26B 17/1433; F26B 17/1441; F26B 17/1457; F26B 17/1458; F26B 17/124; F26B 17/128; F26B 2200/06
USPC ..... 34/165, 167, 168, 170, 171, 174, 175, 34/178; 454/356, 277
See application file for complete search history.

(56) References Cited

U.S. PATENT DOCUMENTS 1,685,338 A * 9/1928 Randolph ..... F26B 17/1416 34/170
2,126,525 A * 8/1938 Anderson ..... B61C 17/04 29/896.6
3,300,873 A * 1/1967 Bussell ..... F26B 17/1416 34/168
7,338,359 B2 * 3/2008 Grossman ..... F24F 7/02 34/233

(Continued)

FOREIGN PATENT DOCUMENTS

BR PI0802885-0 A2 3/2010
BR PI1100649-8 A2 9/2012
BR 102012001750-4 A2 12/2012

*Primary Examiner* — John McCormack
(74) *Attorney, Agent, or Firm* — Zarley Law Firm, P.L.C.

(57) ABSTRACT

The present invention proposes a drying tower with grain flow in parallel and sinuous in combination with reverse and radial crossed air flows in form of "Z" oblique for the implementation in the drying of grains, seeds, fodder, and fruit. Therefore, the grains are firstly submitted to a first stage of parallel grains flow and reverse crossed air flow in order to standardize the different degrees of humidity of the grains and of their impurities. In a second moment, these grains are submitted to a sinuous grains flow and radial air flow in the form of oblique "Z". Such implementation in drying processes of grains upgrades substantially the drying time and the energy spent for such process, generating in this way profit for the food industries.

15 Claims, 8 Drawing Sheets

(56) References Cited

U.S. PATENT DOCUMENTS

2012/0090722 A1* 4/2012 Pacheco Da Cunha .....
A01F 25/22
138/177

* cited by examiner

GRAIN DRYING TOWER OF PARALLEL AND SINUOUS FLOW THROUGH REVERSE CROSSED AIR FLOW AND RADIAL AIR FLOW IN OBLIQUE "Z" FORM

CROSS REFERENCE TO RELATED APPLICATIONS

This application claims the benefit of Brazilian Application No. BR 10 2014 003815 9 filed Feb. 19, 2014.

BACKGROUND OF THE INVENTION

In a general form, the present invention belongs to the technical sector of agricultural machines and equipment and refers, more specifically, to an innovative grain drying tower that uses parallel and sinuous grain flow in combination with reverse crossed air flows and radial air flow in "Z" oblique form.

Among the innumerable grain processing steps in the food industry, one of the fundamental processes is the drying of product after harvest. Drying establishes a balance between the internal humidity of the grain and the environmental humidity. This process enables that the product's high quality is maintained, avoiding at the same time that it may become susceptible to the attack of fungi and insects and, consequently, the deterioration of the grain during storage.

With this, among the equipment known in the art, drying towers have a highlighted roll, as they promote efficient drying of these grains, eliminating their humidity, and making the product less susceptible to such contaminations. Drying is, therefore, an artificial process that has the purpose of preparing the grain to be stored in a correct form avoiding losses of the product through bad storage, commercialization, and processing in the industry. The principal objective of preparing these grains through drying and humidity reduction is to maintain their physical, chemical, and biological characteristics in perfect conditions to be commercialized.

Previously, even before knowing that humidity is the cause fungi and, consequently, contamination of the stored products, grains were dried naturally. In other words, the agriculturist used to let the harvest expose product to the sun and wind in order to reduce the grains humidity. However, it is evident that such became inefficient as years went by, as this form of drying is not controlled as to provide an efficiency, and the time required by such natural drying is large, which negatively impacts the production line. Besides, the product loss during the harvest, as the grain, partially dry, possesses less weight and is more susceptible to be lost during such process.

Fixed bed dryers are known, which consist of manual dryers and of easy conception and low cost. These dryers are, generally, made in a masonry, metal boards, and have a hot air flow blown by a fan. Although presenting a low cost of acquisition, this type of solution requires that grain is dried on the metal boards, and it is necessary that an operator manually performs the movement of the grain to obtain uniform drying. From this point onward, different equipment has been developed to solve the inconvenience present in this foot industry process, reducing the time required to remove water content of the grain. From the studies and perceptions of inconvenience in the daily life, professionals of this branch have worked in developing equipment that fulfills the needs of producers in an efficient manner through practical and functional solutions.

In the present consuming market, dryers of different models and construction forms are known. The food industry trend is to supply a product that fulfills the market demands in an efficient form, allied to the reduction of operation costs and processing time. Dryers available for the treatment of grains generally are those drying towers that supply a hot air and grain flow. As seen in PI100649, a system was developed that has the purpose of integrating the grain drying and cleaning operations simultaneously. The solution foresees the cleaning system located in the superior portion of the drying system and also a heat generator. As can be seen, the solution under issue has a large inconvenience in the maintenance of the cleaning system, which demands periodic inspections in order to maintain its proper functioning. In other words, the difficulty of checking the cleaning system with greater frequency without involving larger costs and risks to the operator is evident.

Besides this, the great majority of the solutions proposed in the market presently foresee a flow of parallel grains, supplying a uniform fall. Although commonly used, this system has the inconvenience of accumulated grains placing pressure on the bottom of the tower reducing the internal space between the grains and reducing drying efficiency. As we can see in PI802885, the dryer presents itself as highly efficient for using all types of air flows possible during a process of humidity removal (concurrent, countercurrent, and crossed flow), besides varying the intensity of the flow in accordance with the characteristics presented by the grains during the process. The implementation of a flow system of radial air has the purpose of supplying a greater area of contact with the grains, however, such invention does not supply a solution for the inconvenience of supplying an efficient drying for grains and/or seeds with smaller humidity, in other words, the solution can be used with efficient results in a smaller range of grains humidity.

It is also worth mentioning the patent of the invention BR 102012001750 4, which proposes a crossed and multidirectional air flow dryer, in order to supply a low gradient of humidity. The solution foresees the parallel flow of grains resulting besides the inconvenience already mentioned: the fact of supplying larger incidence of heat for the drying of the grains of the extremities of the flow. In other words, as the grains flow is parallel, the grain disorder is small and those that are in the more internal layers of the grains flow do not receive the same incidence of heat for drying. Therefore, there is the possibility of the external grains of the grains flow column to be drier than those moving to the more inside of the grains flow column, in this way supplying a more heterogeneous product in relation to humidity.

SUMMARY OF THE INVENTION

The present invention has the purpose of solving the inconvenience present in the state of the technology, proposing a drying tower with grains flow in parallel and sinuous in combination with reverse crossed air and radial in the form of "Z" oblique to implement the drying of grains and seeds.

The proposed drying tower has the purpose of supplying a high efficiency tool of grain drying allied to low consumption of energy. Therefore, when the grain enters the tower, they flow off in a parallel flow and with a crossed air flow in a first stage. Next, the grain is directed to a second stage inside the drying tower in which the grain flows off in a sinuous flow with the air flow falling on in radial form in an oblique "Z" form.

From the system implementation with such combinations of air and grains flow a high degree of drying efficiency of the grain is achieved. In other words, the proposed drying tower views the high performance during the process eliminating high gradients of temperature inside the tower and, consequently, of the grain humidity.

Besides this, the solution proposed enables drying all types of fodders, fruit, and grains. The proposed drying tower also enables the entry of these foods with a high percentage of impurities, dispensing the use of pre-cleaning machines and, consequently, reducing the processing costs.

With this, after the grains and fodders drying inside the proposed drying tower, the impurities are separated from the product and destined to their determined re-use. Also, as the grain and the fodders pass through two stages of drying, it is important to emphasize that the proposed solution enables the grain to be put in the equipment with a high content of humidity.

DETAILED DESCRIPTION

Figure 1:
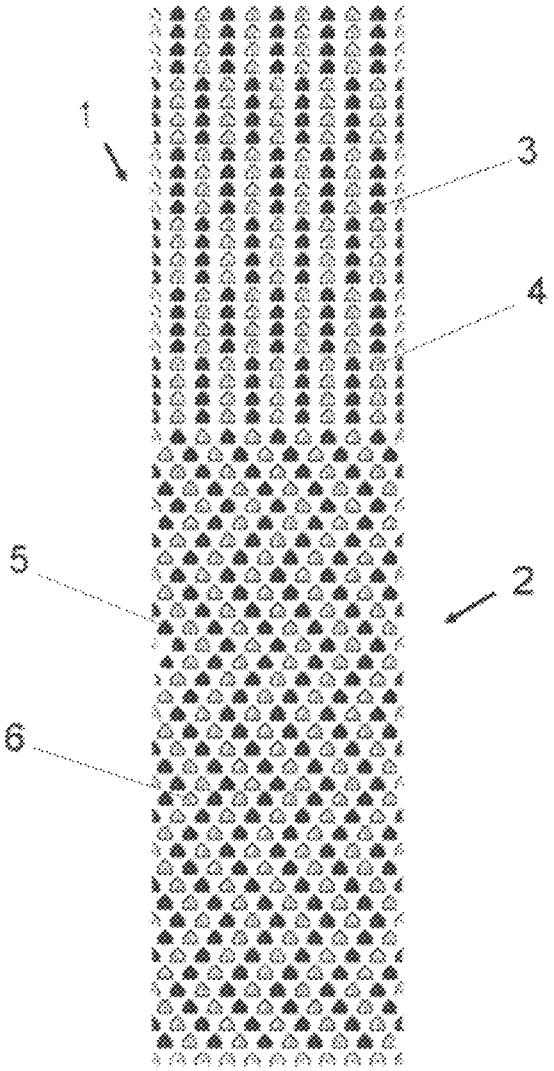
FIG. 1 represents the air entry and exit ducts of the parallel and sinuous flows of the drying tower.
Figure 2:
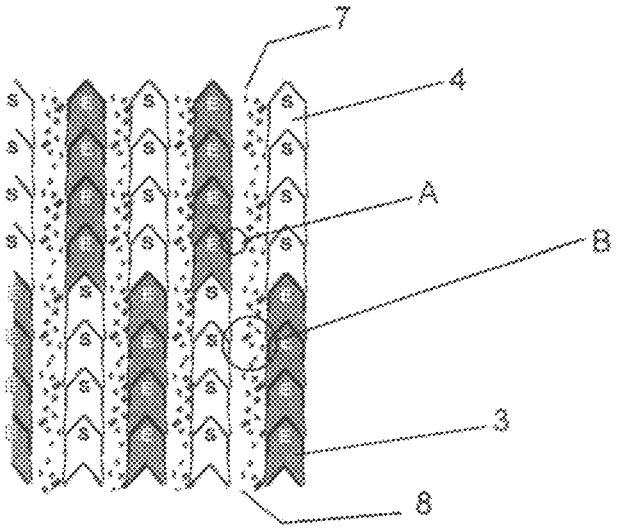
FIG. 2 represents, in an enlarged scale, the grain parallel discharge ducts.
Figure 3:
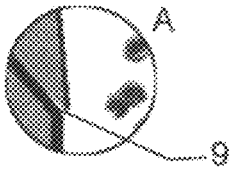
FIG. 3 represents, in an enlarged scale, the detail A of the FIG. 2, evidencing the opening between one and another ducts and the residues exit.
Figure 4:
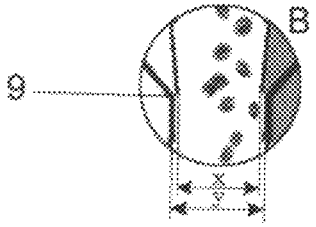
FIG. 4 represents, in an enlarged scale, the detail A of the FIG. 2, evidencing the area reduction and expansion of the grains flow.
Figure 5:
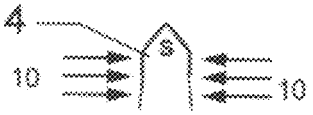
FIG. 5 represents the exit air flow direction used in the grains parallel flow.
Figure 6:
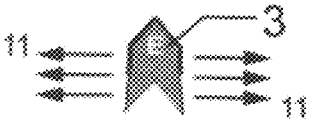
FIG. 6 represents the entry hot air flow direction in the grains parallel flow.
Figure 7:
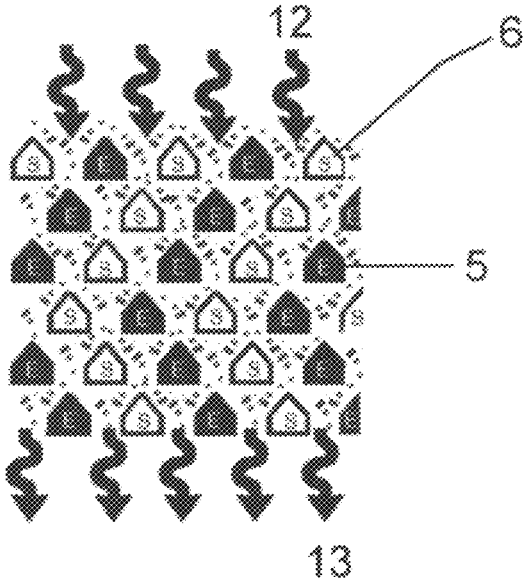
FIG. 7 represents, in an enlarged scale, the sinuous drainage ducts of the grain.
Figure 8:
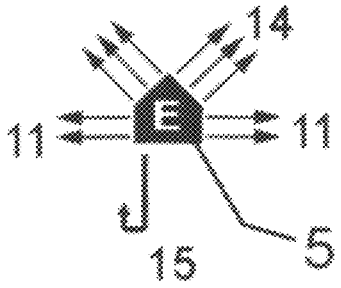
FIG. 8 represents the hot air entry flow into the duct of sinuous grain flow.
Figure 9:
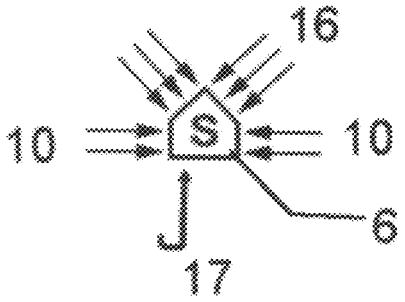
FIG. 9 represents the direction of the exit air flow used in the sinuous grain flow.
Figure 10:
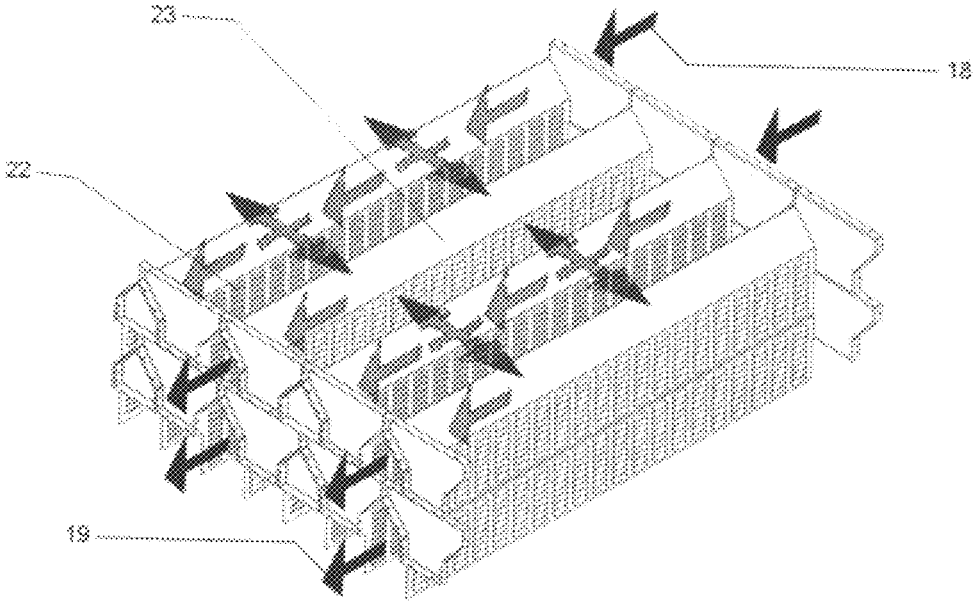
FIG. 10 represents a form of assembly of ducts of parallel grains flow in the inside of the drying tower.
Figure 11:
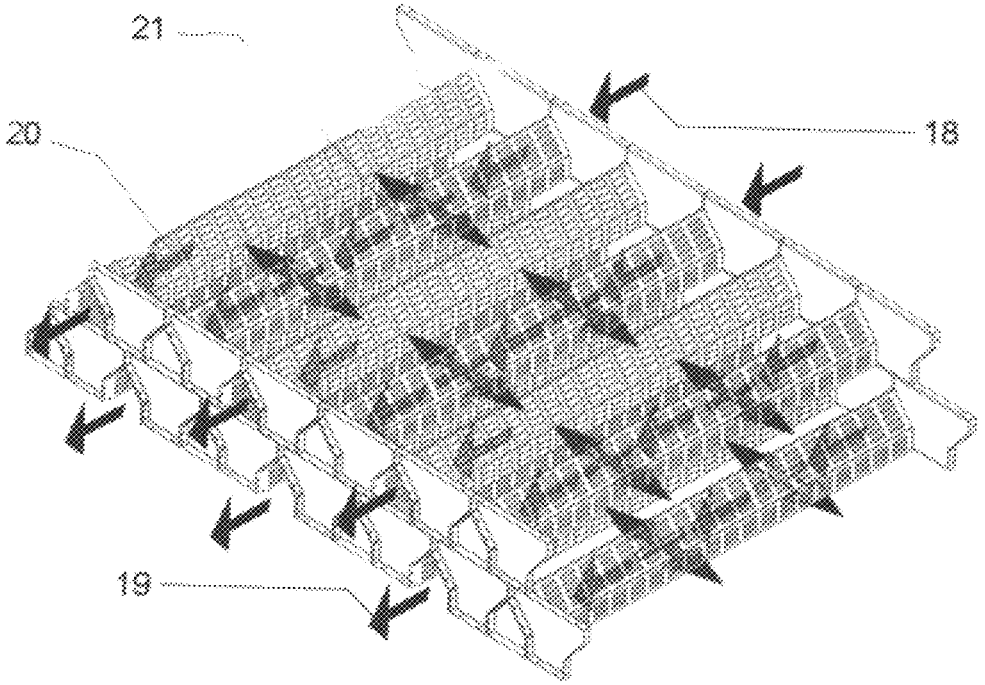
FIG. 11 represents a form of assembly of ducts of sinuous grains flow in the inside of the drying tower.
Figure 12:
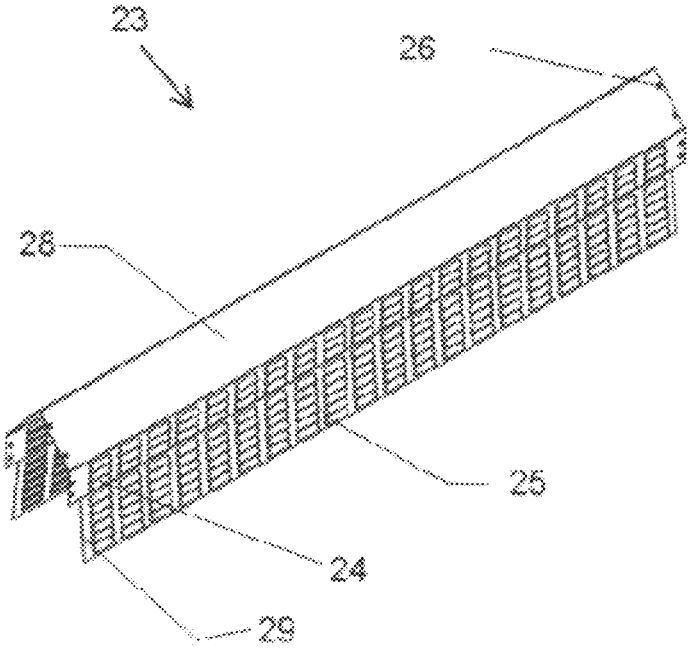
FIG. 12 represents the air exit duct of the stage of parallel grains flow.
Figure 13:
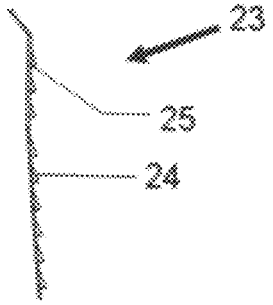
FIG. 13 represents the air exit duct of the stage of parallel grains flow in a cut.
Figure 14:
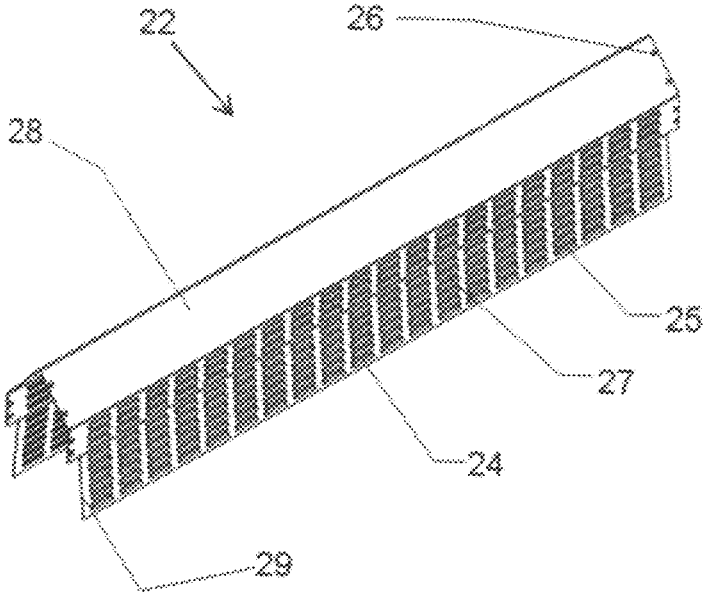
FIG. 14 represents the air entry duct of the stage of parallel grains flow.
Figure 15:
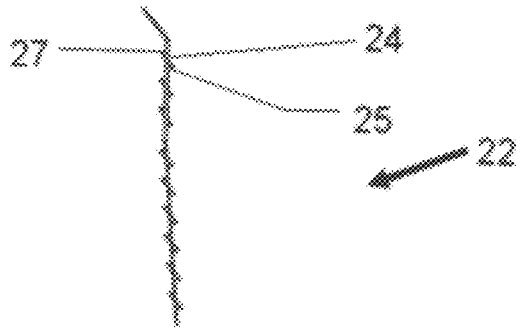
FIG. 15 represents the air entry duct of the stage of parallel grains flow in a cut.
Figure 16:
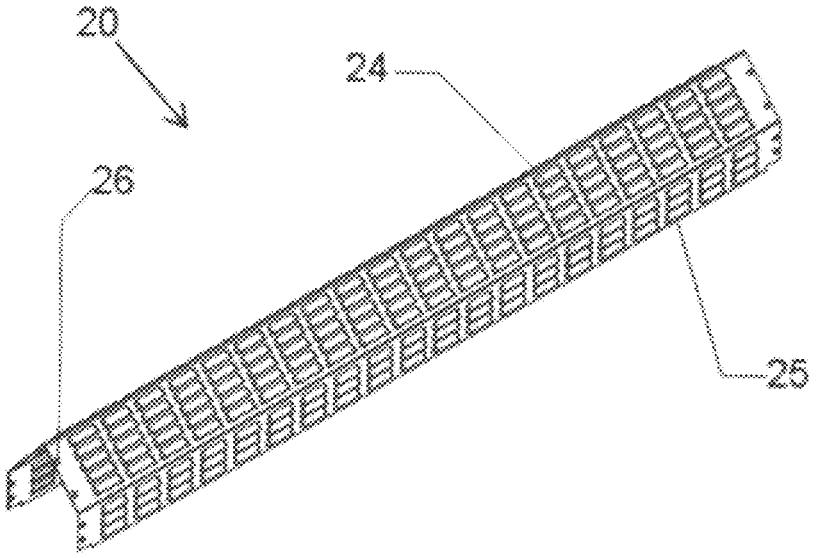
FIG. 16 represents the air exit duct of the stage of sinuous grains flow.
Figure 17:
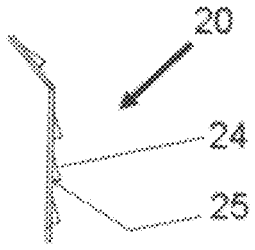
FIG. 17 represents the air exit duct of the stage of sinuous grains flow in a cut.
Figure 18:
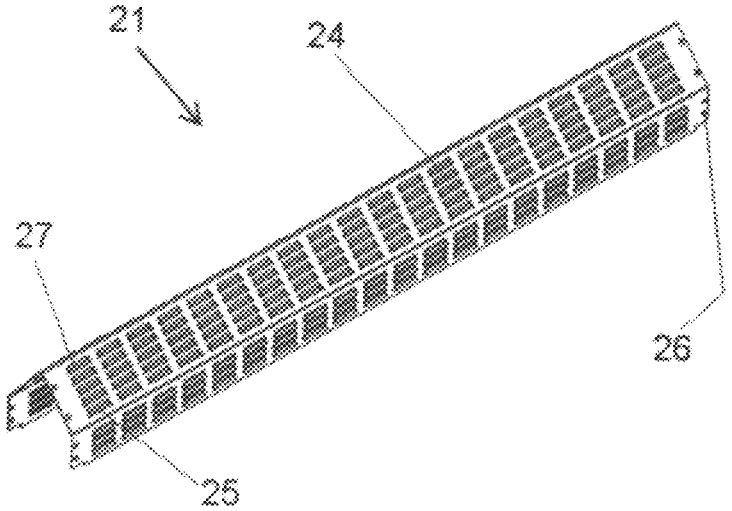
FIG. 18 represents the air entry duct of the stage of sinuous grains flow.
Figure 19:
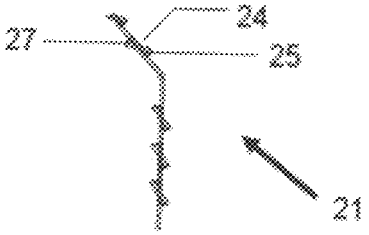
FIG. 19 represents the air entry duct of the stage of sinuous grains flow in a cut.

As can be concluded from the annexed figures, the present invention consists of a tower for drying agricultural products with the combination of parallel and sinuous grain flows in order to promote greater efficiency of drying grains, seeds, fodder, and fruit with high content of impurities.

The solution consists basically of a tower that submits the grain to two drying stages: in a first moment to a parallel flow of grain (1) and later through a sinuous flow of grain (2). The parallel flow of grain (1) uses a crossed and reverse air flow for the due heating and, consequently, drying the grain. During this drying stage the grains flow in a homogeneous form and with a low degree of disorder and the drying air air-ducts are set parallel limiting the entry way (7) and the exit (8) to be passed by the grains and the air to pass the air-duct extension way (18) (19). Such stage of the parallel grains flow (1) presents hot air entry air-ducts (3) and used air exit air-ducts (4), in which the air respectively permeates with the air entry direction (10) in the exit air-ducts (4) and in the exit direction (11) of hot air in the entry air-ducts (3). In this way, hot air is pulled through an entry air-duct (3), permeates between grains exchanging heat with the same and exists in the form of used air in an exit air-duct (4).

In the stage of parallel grain flow (1) it is also important to mention that the air-ducts (3) and (4) of crossed and reverse flow are distributed alternatively through air flows exiting to the right and afterwards air flows exiting to the left and successively in this way. These air-ducts (3) (4) are also designed in a self-cleaning form, which enables the removal of impurities through a slit (9) between the superposed air-ducts, evidenced in the detail A. Besides this, the superposed air-ducts form an x-reduction system and y-expansion system in the grains outflow area in order to homogenize the humidity during its way in parallel in the proposed drying tower. From this, it is important to highlight that the fact of using firstly a flow of grains in parallel is due to the ease of moving the product, free of obstacles and effective standardization of the grains humidity. With this, is provided a higher drying speed, preparing the grain to enter into the inferior stages with the proper humidity in order to promote an efficient operation of drying and, consequently, a high quality product.

After the products exit (8) from the first drying stage with parallel grains flow (1), the grain is submitted to a treatment in a second state of sinuous grains flow (2) and a flow of radial air in "Z" oblique through the way (12)(13). Therefore, the grain enters (12) in the second drying stage (2) with a relatively lower humidity. The second drying stage of sinuous grains flow (2) is constituted by hot air entry air-ducts (5) and used air exit air-ducts (6) positioned horizontally parallel and divergent in oblique form in relation to the vertical axis, forming a way in "Z" format of the air. The air-ducts (5) (6) under issue are also the radial air flow suppliers, in other words, they enable the incidence of hot air and pick up through all sides of the air-ducts. With this, the hot air entry air-duct (5) has horizontal exit currents (11), oblique (14) and inferior current in concurrent (15). The used air exit air-duct (6) on its turn receives entry horizontal air currents (10), oblique ones (16), and counter-current inferior current (17).

This configuration and disposition of the air-ducts (5) (6) allows the grains to run in heterogeneous form, performing the due mixture of grains and supplying hot currents that exchange heat with all the grains that run through the drier. With this, the high efficiency of reduction of the remaining humidity is evident viewing a product of high quality and avoiding the grains to burn on one side and not on the other, supplying a product of low quality. Besides this, it is important to mention that the second stage of sinuous grains flow and radial air flow (2) reduces the breakage through impact of partially dry grains, generating a product of high quality in the market.

Still referring to the air-ducts implemented in the solution described herein, these are designed in a form that the air entry air-duct has windows on each transversal line (24) with inferior openings (25) and superior ones (27), totalizing approximately 32 to 36 openings in order to reduce the speed of the entry air with full heating of the grains and evaporation of the water. The used air exit air-ducts on their turn, present windows (24) on each transversal line with inferior opening (25) for the due extraction of saturated air.

With this, the air-ducts under issue have, approximately, 16 to 18 openings in order to extract with higher speed this air that has smaller potential of drying. In other words, from the implementation of air-ducts with only one inferior opening (25) is promoted an acceleration of the final air speed as to its potential of transport and vapor extraction.

It is also worth mentioning that in the drying tower under issue is foreseen unaligned transversal lines between the air-ducts in order to eliminate the air directing lines in their axis, coincident with the flow of air viewing to eliminate drying gradients. Therefore, are eliminated the humidity gradients of the drying flows of the crossed, countercurrent, concurrent, and oblique air currents when they run through the grains in a horizontal or radial level.

Example 1

The air-ducts of the stage of parallel grains flow (1) is basically the case of air-ducts (22) (23), being a structure with superior smooth walls (28) and side walls (29) with windows (24). The hot air entry air-duct has superior openings (27) and inferior ones (25), while the used air entry air-ducts have only inferior openings (25) on their windows (24). The air-ducts (22) (23) are fixated through holes (26).

Example 2

The air-ducts of the stage of sinuous grains flow (2) is basically the case of air-ducts (21) (22), being a structure with windows (24). The hot air entry air-duct has superior openings (27) inferior (25), while the used air entry air-ducts have only inferior ones (25) on their windows (24). The air-ducts (20)(21) are fixated through holes (26).

The figures and description performed do not have the intention to limit the inventive concept execution forms now proposed, but to illustrate and make understandable the conceptual innovations revealed in this invention, so that the descriptions and images must be interpreted in an illustrative form and exemplificative, but not limitative, as other equivalent or analogous forms of implementation of the inventive concept now revealed may exist and that do not escape from the spectrum of protection delineated in this invention.

In the present descriptive report was dealt about a peculiar and innovative drying tower of agricultural products, capable to highly perfection its use, with novelty, inventive activity, descriptive sufficiency, and industrial application and, consequently, with all essential requisites for the concession of the requested privilege.

What is claimed is:

1. A grain drying tower of parallel and sinuous flow through reverse cross air flow and radial air flow in oblique "Z" form containing hot air entry air-ducts and used air exit air-ducts, grain flow and incidence of hot air flow characterized for being made-up by a first stage (1) with parallel grains flow (7)(8) and reverse crossed air flow combined with a second stage (2) with sinuous grains flow (12)(13) and radial air flow.

2. A grain drying tower of parallel and sinuous flow through reverse cross air flow and radial air flow in oblique "Z" form according to claim 1, and also characterized by the first stage (1) of parallel grain flow having air-ducts (3)(4) of crossed and reverse flow distributed in alternate form through air flows exiting to the right and air flows exiting to the left.

3. A grain drying tower of parallel and sinuous flow through reverse crossed air flow and radial air flow in oblique Z" form according to claim 2, and also characterized by the air-ducts (3)(4) of the first stage (1) with parallel grain flow (7)(8) having a slit (9) between the air-ducts (3)(4).

4. A grain drying tower of parallel and sinuous flow through reverse crossed air flow and radial air flow in oblique "Z form according to claim 2, and also characterized for the air-ducts (3)(4) of the first stage (1) with parallel grain flow (7)(8) having a system of reduction (x) and expansion (y) in the area of grain outflow.

5. A grain drying tower of parallel and sinuous flow through reverse crossed air flow and radial air flow in oblique "Z" form according to claim 1, and also characterized by a stage of sinuous grain flow (2) being made-up by hot air entry (5) air-ducts and used air exit air-ducts (6) positioned parallel horizontally and in oblique disorder form in relation to the vertical axis.

6. A grain drying tower of parallel and sinuous flow through reverse crossed air flow and radial air flow in oblique "Z" form according to claim 1, and also characterized for the hot air entry air-duct (5) having horizontal exit air flows (11), oblique (14), and inferior air flow in concurrent (15).

7. A grain drying tower of parallel and sinuous flow through reverse crossed air flow and radial air flow in oblique "Z" form according to claim 1, and also characterized for the used air exit air-duct (6) receiving horizontal entry air flows (10), oblique (16), and countercurrent inferior air flow (17).

8. A grain drying tower of parallel and sinuous flow through reverse crossed air flow and radial air flow in oblique "Z" form according to claim 1, and also characterized for the hot air entry air-ducts having on each transversal line windows (24) with inferior (25) and superior (27) openings.

9. A grain drying tower of parallel and sinuous flow through reverse crossed air flow and radial air flow in oblique "Z" form according to claim 1, and also characterized for the used air exit air-ducts having on each transversal line windows (24) with inferior opening (25).

10. A grain drying tower of parallel and sinuous flow through reverse crossed air flow and radial air flow in oblique "Z" form according to claim 1, and also characterized for having disagreement of the transversal lines between the hot air entry air-ducts and the used air exit air-ducts.

11. A grain drying tower comprising:

an entry and an exit, with a parallel flow portion and a sinuous flow portion positioned therebetween;

the parallel flow portion including a first plurality entry air-ducts and a first plurality of used air entry air-ducts, wherein a crossed and reverse air flow is pulled through the first plurality of entry air-ducts, permeates grain flowing in a parallel flow, and exits the first plurality of used air entry ducts; and the sinuous flow portion including a second plurality of entry air-ducts and a second plurality of used air entry air-ducts positioned horizontally parallel and divergent in oblique form in relation to a vertical axis, wherein air flow is pulled though a second plurality of entry air-ducts in a "Z" format, permeates grain flowing in a heterogeneous form, and exits the second plurality of used air entry ducts.

12. The grain drying tower of claim 11 wherein the "Z" format is formed by grain flowing off in a sinuous flow with the air flow falling on the on the sinuous flow in radial form.

13. The grain drying tower of claim 11 wherein the grain flow is heterogeneous and one or more humidity gradients within the tower are homogeneous.

14. The grain drying tower of parallel and sinuous flow through reverse crossed air flow and radial air flow in oblique "Z" form of claim 1 wherein the second stage of sinuous grain flow and radial air flow reduces grain breakage through impact of partially dry grain.

15. The grain drying tower of parallel and sinuous flow through reverse crossed air flow and radial air flow in oblique "Z" form of claim 4 wherein the (x) reduction system and (y) expansion system homogenizes humidity within the tower.

* * * * *